US008906293B2

(12) United States Patent
Mukai et al.

(10) Patent No.: US 8,906,293 B2
(45) Date of Patent: Dec. 9, 2014

(54) MAGNESIUM ALLOY

(75) Inventors: Toshiji Mukai, Ibaraki (JP); Hidetoshi Somekawa, Ibaraki (JP); Tadanobu Inoue, Ibaraki (JP); Alok Singh, Ibaraki (JP)

(73) Assignee: National Institute for Materials Science, Ibaraki (JP)

( * ) Notice: Subject to any disclaimer, the term of this patent is extended or adjusted under 35 U.S.C. 154(b) by 845 days.

(21) Appl. No.: 12/734,001

(22) PCT Filed: Oct. 2, 2008

(86) PCT No.: PCT/JP2008/067962

§ 371 (c)(1),
(2), (4) Date: May 19, 2010

(87) PCT Pub. No.: WO2009/044829

PCT Pub. Date: Apr. 9, 2009

(65) Prior Publication Data

US 2010/0254849 A1 Oct. 7, 2010

(30) Foreign Application Priority Data

Oct. 2, 2007 (JP) ..... 2007-258302

(51) Int. Cl.

| | |
|---|---|
| ***C22C 23/00*** | (2006.01) |
| ***C22F 1/06*** | (2006.01) |
| ***C22C 1/00*** | (2006.01) |
| ***C22C 23/02*** | (2006.01) |
| ***C22F 1/00*** | (2006.01) |

(52) U.S. Cl.

CPC . *C22F 1/06* (2013.01); *C22C 1/002* (2013.01); *C22C 23/02* (2013.01); *C22F 1/00* (2013.01)

USPC ..... 420/402; 148/420

(58) Field of Classification Search

CPC ..... C22C 23/00; C22F 1/06

USPC ..... 420/407–413, 402; 148/420, 666

See application file for complete search history.

(56) References Cited

U.S. PATENT DOCUMENTS

2006/0283529 A1* 12/2006 Ghosh et al. ..... 148/557

* cited by examiner

*Primary Examiner* — Roy King
*Assistant Examiner* — Caitlin Kiechle
(74) *Attorney, Agent, or Firm* — Wenderoth, Lind & Ponack, L.L.P.

(57) ABSTRACT

An object of the invention is to provide a magnesium alloy having high strength and sufficient formability. A magnesium alloy mainly contains magnesium and has high tensile strength and high compression strength. The crystal grain structure of the alloy has a high angle grain boundary, and the inside of the crystal grain surrounded by the high angle grain boundary is composed of subgrains.

5 Claims, 7 Drawing Sheets

MAGNESIUM ALLOY

This application is a U.S. national stage of International Application No. PCT/W2008/067962 filed Oct. 2, 2008.

TECHNICAL FIELD

The present invention relates to a magnesium alloy mainly comprising magnesium and having good formability, which has high tensile strength/high compression strength.

BACKGROUND ART

High-strength magnesium alloys have been developed recently and have been specifically noted as new materials replaceable for aluminum alloys for constitutive materials for automobiles, aircraft, etc.

However, these are poorly processable in use for industrial materials, and various developments have been made for improving them, but satisfactory ones could not as yet been obtained.

For example, a method of producing extrusion-processed materials has been investigated as the measure for enhancing the ductility thereof; however, in this case, it is difficult to increase the compression strength of the materials, and there occurs a problem in that the deformation anisotropy, which is a ratio of compressive yield stress to tensile yield stress, increases and the materials are difficult to use for lightweight structural materials.

DISCLOSURE OF THE INVENTION

Problems that the Invention is to Solve

In the context of the situation as above, an object of the invention is to provide a novel magnesium alloy having high strength and sufficient formability.

Means for Solving the Problems

The magnesium alloy of the invention 1 is characterized in that its crystal grain structure has a high angle grain boundary, and the inside of the crystal grain surrounded by the high angle grain boundary is composed of subgrains.

The invention 2 is characterized in that, in the magnesium alloy of the invention 1, the crystal grains have a mean grain size of at most 5 μm and the subgrains have a mean grain size of at most 1.5 μm.

The invention 3 is characterized in that the crystal grains having a mean grain size of at most 5 μm account for at least 70% of all the crystal grains.

Advantage of the Invention

According to the invention as described above, there is realized a magnesium alloy having high ductility and having excellent strength characteristics of high tensile strength/high compression strength, etc. Heretofore, this was difficult to anticipate and realize.

The magnesium alloy of the invention enables deformation of the crystal grains themselves owing to the peculiar crystal structure as mentioned above, or that is, owing to the existence of the crystal subgrains therein; but it is presumed that the intergranular slip in the alloy could be inhibited and the alloy could satisfy both the characteristics of good ductility and high strength.

Owing to the ductility, any desired long-size rod-like materials can be formed of the alloy.

As compared with an ordinary extrusion method, rolling method and drawing method, the invention can produce materials having a large cross section necessary for exerting a strength on the same level as that of the materials produced according to such ordinary methods, and can contribute toward development of lightweight structural materials of magnesium, for example, for large-size construction members, etc.

BEST MODE FOR CARRYING OUT THE INVENTION

The magnesium alloy of the invention is characterized by the crystal grain structure thereof, and the crystal grain structure has:

1) a high angle grain boundary, and 2) the inside of the crystal grain surrounded by the high angle grain boundary is composed of subgrains.

The "high angle grain boundary" is defined as a grain boundary having a misorientation angle of at least 15 degrees. The high angle grain boundary is concretely confirmed by crystal orientation mapping through SEM/EBSD (scanning electron microscopy/electron back-scattered diffraction) or by misorientation angle measurement through transmission electromicroscopy.

"Subgrains" are defined as those having a grain boundary with a misorientation angle of at most 5 degrees. The subgrains are meant to indicate the regions slightly differing from each other in the crystal lattice angle, which are formed inside the crystal grain surrounded by the high angle grain boundary. They have a structure of such that the inside of the crystal grain is divided into aggregations of lattices (subgrains) having a misorientation angle of at most 5 degrees.

Of the magnesium alloy of the invention, the characteristic level is higher than that of ordinary alloys; and as having the crystal grain structure of the above 1) and 2), the alloy of the invention realizes:

an elongation value of at least 10%, and a tensile strength of at least 330 MPa.

In addition, the alloy realizes:

a tensile yield stress (A) of at least 300 MPa, a compressive yield stress (B) of at least 220 MPa, and a yield stress anisotropy ratio (B/A) of at least 0.7.

The magnesium alloy having the above-mentioned characteristics 1) and 2) is heretofore unknown. Regarding the composition thereof, the alloy mainly comprises magnesium generally with the proportion of magnesium therein, by mass (% by mass), of being at least 95%, and may be a binary, ternary or more polynary alloy. Various elements may alloy with magnesium, including, for example, Al, Zn, Mn, Zr, Ca, RE (rare earth elements), etc. For example, Mg—Al—Zn, Mg—Al—Zn—Mn, Mg—Zn or the like composition with:

Al: from 2.5 to 3.5% by mass,

Zn: from 0.5 to 1.5% by mass,

Mn: from 0.1 to 0.5% by mass, may be taken into consideration as preferred ones.

For example, AZ31B and the like known ones belonging to AZ31 (JIS H4202) as Mg—Al—Zn—Mn alloys may be taken into consideration.

Al is a preferred alloying element as increasing the strength and enhancing the ductility of the alloy; Zn is a preferred one as increasing the strength; and Mn is a preferred one as preventing the alloy from being contaminated with any other impurity element such as iron or the like.

Owing to the above-mentioned characteristics thereof of 1) high angle grain boundary and 2) crystal subgrains, the magnesium alloy of the invention realizes good ductility and high-strength characteristics, and for its production, introduction of plastic strain is considered as an effective measure.

"Plastic strain" as referred to herein is defined as permanent deformation to be attained through application of a load at a predetermined temperature. The plastic strain introduction is considered as application of a severe shear straining of, for example, rolling with a grooved roll, extrusion processing at a high extrusion ratio, rolling under a high reduction ratio, ECAE (equal-channel-angular-extrusion) or the like, as demonstrated in Examples.

The rolling with a grooved roll is shown in references, for example, in Inoue et al., Journal of the Japan Institute of Metals, 69 (2005) 943; T. Inoue et. al., Mater. Sci. Eng., A466 (2007) 114; Y. Kimura et. al., Scripta Mater., 57 (2007) 465. In this, the surface of the rolling mill to be used is worked to have grooves having a triangular or the like cross-section configuration; and in case where a triangular cross-section grooves are formed, the method is characterized in that diamond-like holes are formed when the upper and lower rolls are kept in contact with each other. In producing the magnesium alloy of the invention, the rolling with a grooved roll is a preferred measure; and for the profile of the grooves in this case, preferably considered are those to form the above-mentioned diamond-like holes, as well as others to form hexagonal holes or oval holes; and the roll peripheral speed is preferably within a range of from 1 to 50 m/min. In rolling with a grooved roll, preferably, the alloy is previously heated at a temperature falling within a range of from 100 to 300° C. for a period of time falling within a range of from 5 to 120 minutes.

In the "plastic strain introduction" according to various measures of typically rolling with a grooved roll as described in the above, for example, preferably, the entire material is kept heated uniformly at a temperature at which the material can pass through the system with no risk of being broken, and thereafter strain is repeatedly introduced into the material. In this stage, the cross section reduction ratio may be suitably set in relation to the conditions for the plastic strain introduction. In other words, the cross section reduction ratio may be set to satisfy the condition of forming the crystal grain structure characterized by the above 1) and 2) of the alloy of the invention. For example, as shown in Examples, the cross section reduction ratio may be set to be 47%, 64%, 95%, etc.

In the magnesium alloy of the invention, the plastic strain introduction to a cross section reduction ratio of at least 90% noticeably increases the strength of the alloy not detracting from the good ductility of the alloy, for example, as shown in Examples.

For the strain introduction, preferably, a strain introduction step of plural passes is attained repeatedly, and in this case, the strain to be introduced in a single pass may bring about a cross section reduction ratio of, for example, from 10 to 20%.

Of the crystal grains surrounded by a high angle grain boundary, the proportion of the crystal grains having a mean grain size of at most 5 μm increases with the increase in the processing strain introduction (cross section reduction ratio); and for example, when the cross section reduction ratio is at least 90%, then the above proportion may be at least 90%, and, in addition, the crystal structure where the mean grain size of the subgrains in the crystal grain of the type is at most 1.5 μm may account for at least 70% of the entire crystal grain structure.

For example, the characteristics of the magnesium alloy of the invention having the above-mentioned peculiar crystal grain structure owing to the processing strain introduction as above thereinto are on an extremely excellent level in that the tensile yield stress (A) thereof is at least 300 MPa, the compressive yield stress (B) thereof is at least 220 MPa and the yield stress anisotropy ratio (A/B) thereof is at least 0.7.

The invention is applicable to Mg—Al—Zn alloys or Mg—Zn alloys, of which the compositions are generally commercialized, and can impart thereto dramatic high strength heretofore unknown in the art while securing the ductility and the toughness of the alloys, and therefore makes it possible to propose a novel magnesium-based wrought material.

Further, the invention is applicable to materials having a large cross section and to long-size materials having a complicated configuration, and is applicable to large-sized materials, and the practical applicability of the invention is expected.

EXAMPLES

Shear strain was repeatedly introduced into a commercially available magnesium alloy through heat treatment and rolling with a grooved roll. As an example, AZ31 alloy (Mg-3 mas. % Al-1 mas. % Zn-0.2 mas. % Mn) was used. In every Example, the starting material is a hot-extruded material having a diameter of 42 mm (Comparative Example 1).

Before the process, the heating temperature was 200° C. The material was kept in a heating furnace for 30 minutes, and then repeatedly rolled with a grooved roll. In this, the roll surface temperature was room temperature, and the roll peripheral speed was 30 m/min. Regarding the groove profile of the grooved roll, the rolling attained in the manner mentioned below using the roll gave diamond-shaped holes. The cross section reduction ratio in the rolling with the grooved roll was 18% in one pass, and at most 16 passes were repeated.

The mechanical properties of the material thus processed here are shown in Table 1.

In Comparative Example 2 in Table 1, the same starting material was extrusion-processed at a temperature of 210° C. and an extrusion ratio of 25/1. In Comparative Example 3, the same starting material was extrusion-processed using an ECAE mold having a hole diameter of 20 mm and a hole-crossing angle of 90 degrees, at a temperature of 200° C., in which the material was rotated by 90 degrees at every pass, and 8 passes were repeated.

TABLE 1

| | Material | Process | Cross Section Reduction Ratio (%) | Cross Section ($mm^2$) | Crystal Grain Size (μm) | Compressive Yield Stress (MPa) | Tensile Yield Stress (MPa) | Tensile Strength (MPa) | Elongation (%) | Yield Stress Anisotropy Ratio |
|---|---|---|---|---|---|---|---|---|---|---|
| Comparative Example 1 | AZ31 | extrusion | — | 1385 | 25 | 120 | 210 | 280 | 12 | 0.571429 |
| Comparative | AZ31 | extrusion | 94 | 77 | 1 | | 275 | 320 | 29 | |

TABLE 1-continued

| | Material | Process | Cross Section Reduction Ratio (%) | Cross Section ($mm^2$) | Crystal Grain Size (μm) | Compressive Yield Stress (MPa) | Tensile Yield Stress (MPa) | Tensile Strength (MPa) | Elongation (%) | Yield Stress Anisotropy Ratio |
|---|---|---|---|---|---|---|---|---|---|---|
| Example 2 | | | | | | | | | | |
| Comparative Example 3 | AZ31 | ECAE | — | 314 | 4 | 230 | 230 | 285 | 30 | 1 |
| Example 1 | AZ31 | grooved rolling | 47 | 723 | | 222 | 301.5 | 334 | 12.5 | 0.736318 |
| Example 2 | AZ31 | grooved rolling | 64 | 486 | 3.4 | 229 | 301.5 | 339 | 12.5 | 0.759536 |
| Example 3 | AZ31 | grooved rolling | 76 | 327 | 3.3 | 244 | 316 | 349 | 12.7 | 0.772152 |
| Example 4 | AZ31 | grooved rolling | 89 | 148 | | 269 | 341 | 366 | 15 | 0.788856 |
| Example 5 | AZ31 | grooved rolling | 92 | 99 | 2.5 | 289 | 369 | 386 | 11.5 | 0.783198 |
| Example 6 | AZ31 | grooved rolling | 95 | 67 | >2 | 337 | 409 | 422 | 11 | 0.823961 |

For evaluating the strength and the ductility, a round rod test piece having a parallel part diameter of 3 mm and a parallel part length of 15 mm was used as the tensile test piece according to JIS.

The cross section reduction ratio and the cross section of the processed material are shown in Table 1. As a result of the strain introduction in the process, the cross section reduced, the strength increased and the ductility was kept as such. Specifically, as compared with the starting material (Comparative Example 1), the sample in Example 1 realized strength increase of about 85% as the compressive yield strength thereof, while keeping the ductility on the same level. The material in Example 6 that had been processed to have a cross section reduction ratio of 95% realized the increase in the compressive yield strength by about 2.8 times and the tensile yield strength by about 2 times.

As compared with the directly-extruded material that had been processed to have the cross section on the same level (Comparative Example 2), the tensile yield strength of the material of Example 6 increased by 49%, from which the significance of the material of the invention for strength increase is obvious.

FIG. 1 shows an example of the stress-strain curve of the materials having the texture composition of the invention. As compared with the extruded material that was the starting material, the stress of the materials of the invention dramatically increased while the strain thereof was kept on the same level as that of the starting material, and in addition, there appeared strain hardening of the materials of the invention until having the maximum tensile strength to be given thereto in tensile deformation; and these indicate sufficient plastic workability and deformability of the materials of the invention.

One structural characteristic of the material of the invention is that the material has a fine-grained structure having a grain size of at most 5 μm. FIG. 2 shows, as an example of the crystal grain structure of the material in the invention, a photographic picture of SEM/EBSD (scanning electron microscopy/electron back-scattered diffraction) of AZ31 alloy processed to a cross section reduction ratio of 92% based on the starting material (Example 5). In this, the high angle grain boundary having a misorientation angle of at least 15 degrees in crystal orientation analysis through EBSD is shown by the gray boundaries. The mean diameter of the crystal grains surrounded by the high angle grain boundary (for example, the region of with the expression G in the drawing) is computed from the mean area, and is about 2.5 μm; and the crystal grain structure of the material has a uniform crystal grains size distribution as a whole.

The proportion of the crystal grains surrounded by the high angle grain boundary and having a mean grain size of at most 5 μm is 72% in Example 1, 78% in Example 2 and 90% in Example 5.

FIG. 3 shows an example of the basal texture of a material of the invention taken according to an X-ray back-reflection Laue method. In this, the sample of Example 6 having a cross section reduction ratio of 95% is analyzed. As the X-ray source, used was Cu—Kα. In the figure, RD indicates the direction parallel to the grooved rolling, and TD indicates the direction perpendicular to the grooved rolling direction. The curves each indicate the area in which the orientation integration degree is the same.

In the drawing, the contour lines are neither ones similar to concentric circles seen in usual rolled sheets nor belt-like ones parallel to TD seen in usual extruded sheets. Rather they may have a morphology intermediate between the two. Regarding the angle showing the peak of the basal texture intensity of the materials of the invention, the peak is inclined by about 10 degrees in the right direction to TD and by about 5 degrees in the lower direction to RD; and it is known that the peak of the bottom orientation is shifted from the center.

FIG. 4 shows an example of the basal texture of the starting material, commercially extrusion material (Comparative Example 1) taken according to an X-ray back-reflection Laue method. The condition in measurement is the same as that for FIG. 3. This material has a texture well seen in an extruded material of magnesium alloy. Specifically, in this, the contour lines indicating the basal texture intensity are formed in parallel to the RD direction. The maximum intensity of the intensity of this starting material is 7.9, while the maximum intensity thereof of the material of the invention is 5.8. In other words, in the material of the invention, the basal texture intensity is low though the material was worked for severe plastic strain application thereto. Further, the distance between the adjacent contour lines is broad. In other words, the intensity of the basal texture is gentle. Owing to the basal orientation distribution characteristics as above, the material of the invention is characterized by having a ductility (tensile elongation) on the same level as that of usual extruded material and having high strength.

FIG. 5, FIG. 6 and FIG. 7 each show examples of an crystal grain structure of AZ31 alloy of Example 3, Example 5 and Example 6, respectively. In the drawings, the expression S indicates an example of a crystal subgrain, and the regions expressed by the same pattern and contrast are also subgrains, and the region near to white and sandwiched between the subgrains are also subgrains. Since the misorientation angle is at most 5 degrees and is small, the boundary (subgrain boundary) is not always clear. In the photographic picture (FIG. 6) by transmission electromicroscopy of the AZ31 alloy processed to a cross section reduction ratio of 92% (Example 5), the subgrains have a mean diameter of about 0.4 μm.

In the photographic picture (FIG. 7) by transmission electromicroscopy of the AZ31 alloy processed to a cross section reduction ratio of 95% (Example 6), the subgrains have a mean diameter of about 0.3 μm.

The subgrain structure on a nano-order is characterized in that it brings about a dramatic strength increase but at the same time does not almost lower the ductility. Specifically, here is provided the material structure of magnesium alloy enabling high strength not detracting from the ductility thereof.

The data of the yield stress in compression shown in Table 1 are compared with each other. The material of Example 6 of the invention has a strength higher by about 2.8 times than that of the starting material, usual extruded material (Comparative Example 1).

The materials of the invention are further characterized in that the deformation anisotropy of compressive yield stress/tensile yield stress thereof, which is, however, characteristic of the extruded material of AZ31 alloy, is minimized or reduced. Specifically, the material of Comparative Example 1 has a yield stress anisotropy ratio (compressive yield stress/tensile yield stress) of 0.57, or that is, its anisotropy is strong; however, the materials of Examples 1 to 6 have a yield stress anisotropy ratio of at least 0.73, and with the increase in the cross section reduction ratio, or that is, with the increase in the strength, the yield stress anisotropy ratio of the materials increases up to 0.82 and is nearer to 1. This means that the materials of the invention have the property near to isotropy.

DESCRIPTION OF REFERENCE SIGNS

Figure 1:
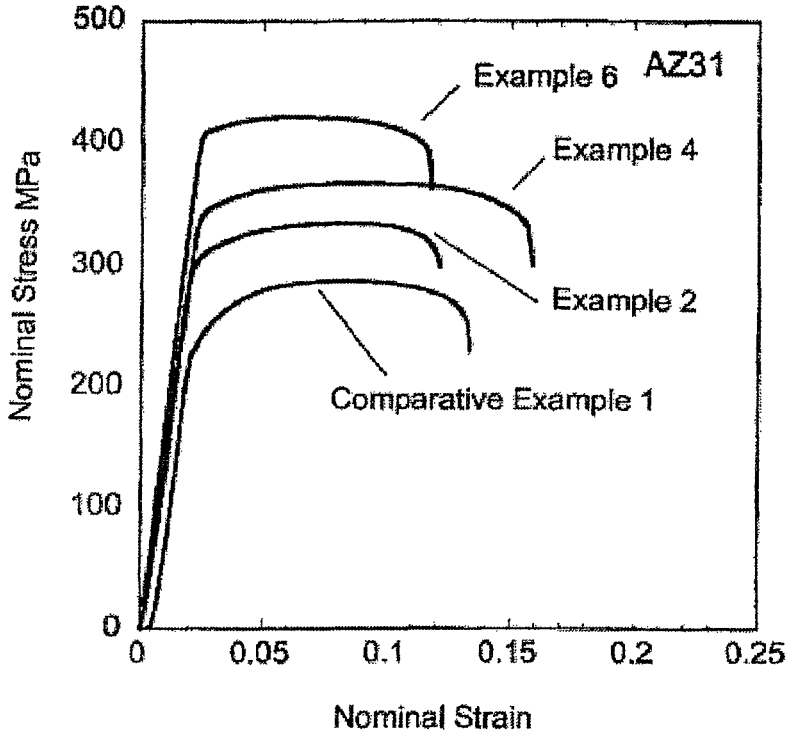
FIG. 1 is a graph of comparing the tensile deformation response in Examples 2, 5 and 6 and Comparative Example 1.
Figure 2:
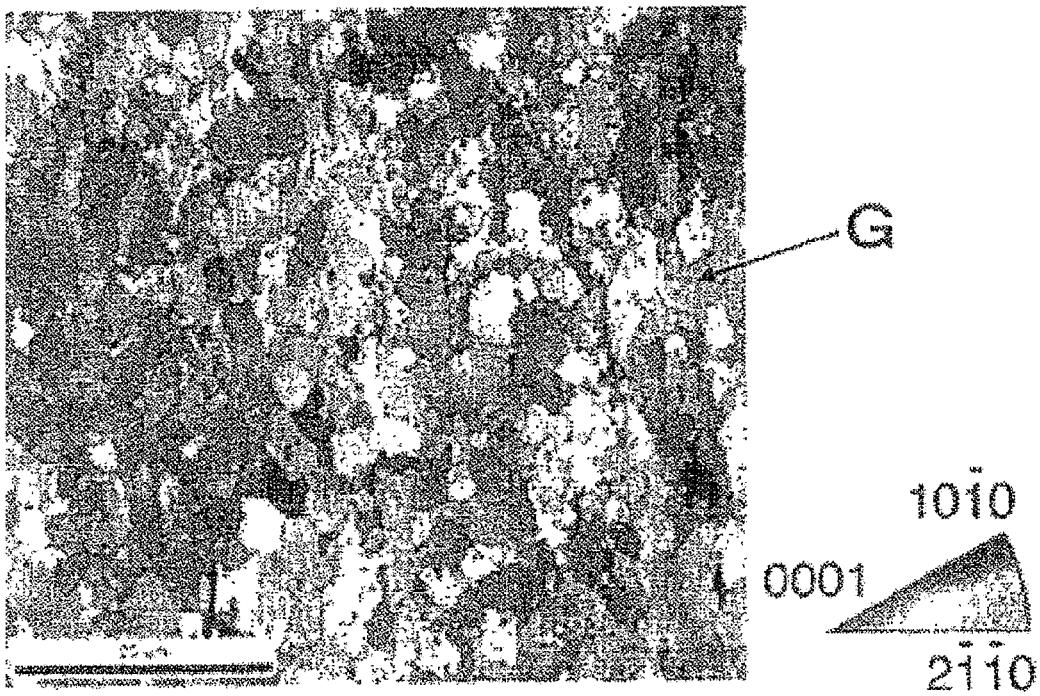
FIG. 2 is a photographic picture of SEM/EBSD (scanning electron microscopy/electron back-scattered diffraction) of the crystal grain texture of Example 5; the right-hand drawing shows a crystal orientation color map; the gray line indicates a high angle grain boundary (misorientation angle: at least 15 degrees); and the region surrounded by the high angle grain boundary shown by G is a crystal grain.
Figure 3:
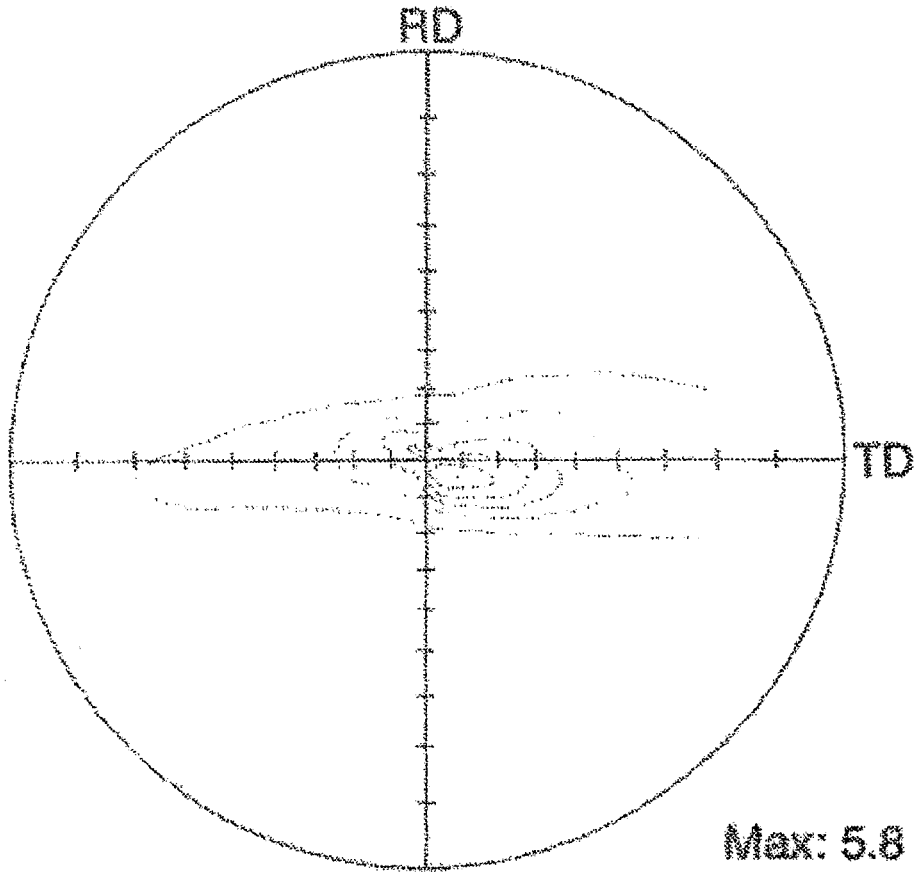
FIG. 3 is a graph showing the basal texture of Example 5; and this shows the maximum peak intensity of X-rays obtained under the test condition of Max. In this, RD indicates the direction parallel to the grooved rolling direction; and TD indicates the direction vertical to the grooved rolling direction.
Figure 4:
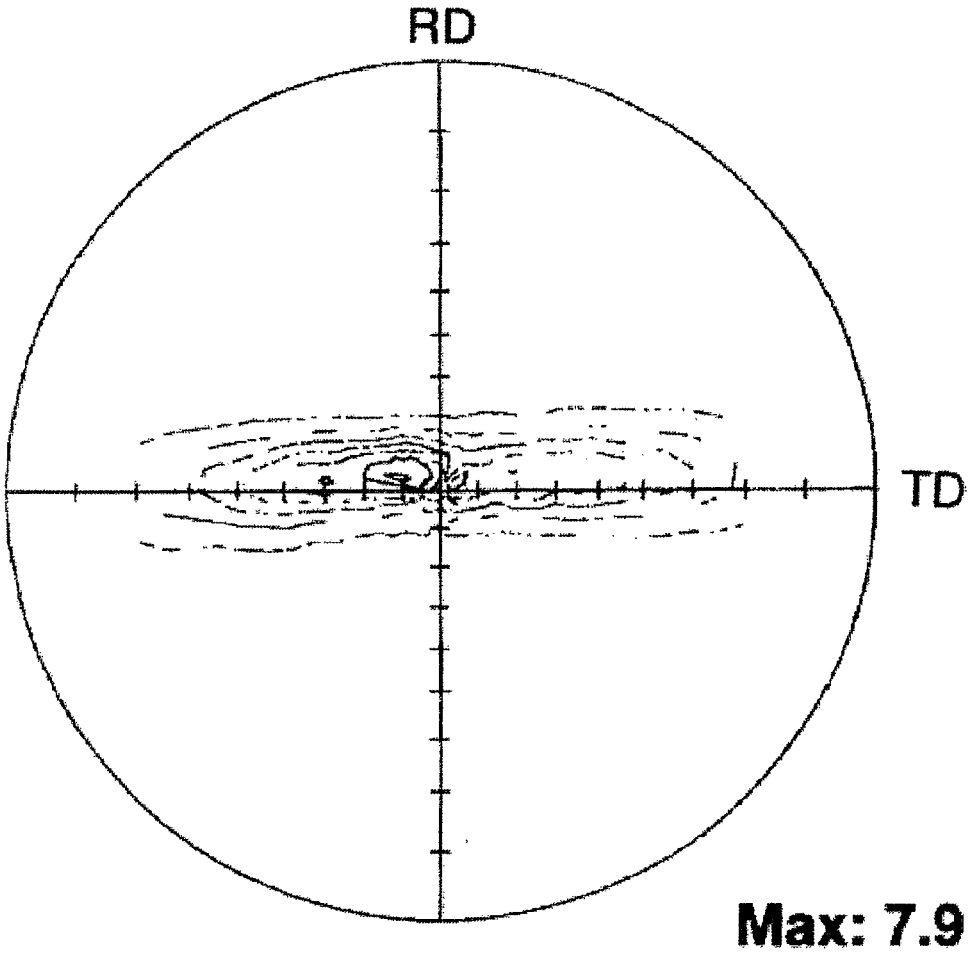
FIG. 4 is a graph showing the basal texture of Comparative Example 1; and this shows the maximum peak intensity of X-rays obtained under the test condition of Max. In this, RD indicates the direction parallel to the extrusion direction; and TD indicates the direction vertical to the extrusion direction.
Figure 5:
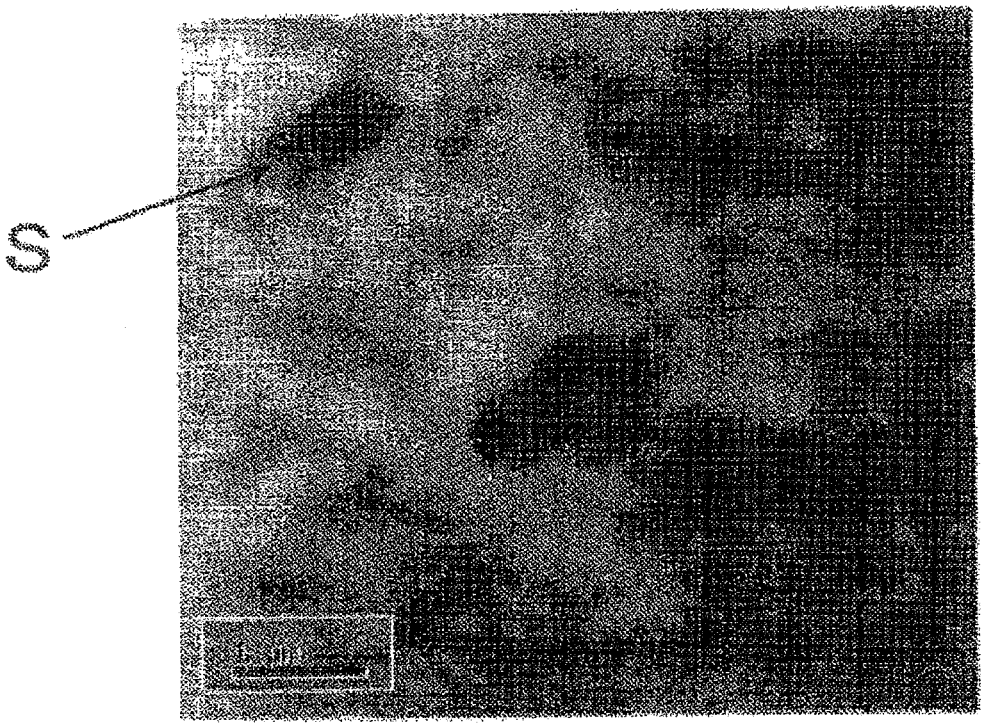
FIG. 5 is a photograph of the microstructure of the alloy of Example 3; S indicates an example of subgrain, and the region shown by the same pattern and the same contrast is subgrain; and the regions near to white and sandwiched between the subgrains are also subgrains.
Figure 6:
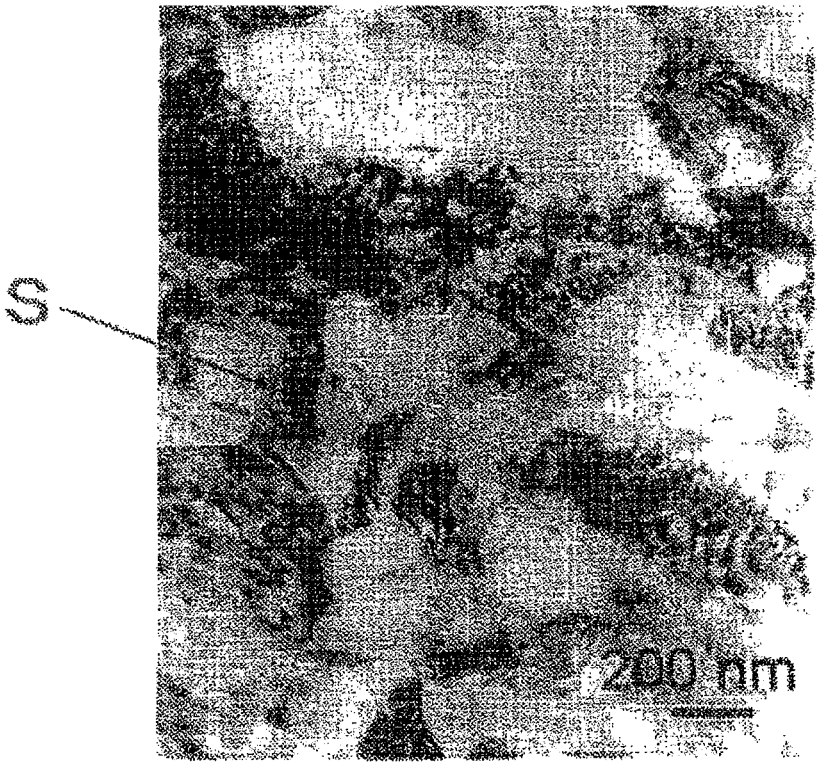
FIG. 6 shows the crystal grain structure of Example 5; S indicates an example of subgrain, and the region shown by the same pattern and the same contrast is subgrain; and the regions near to white and sandwiched between the subgrains are also subgrains.
Figure 7:
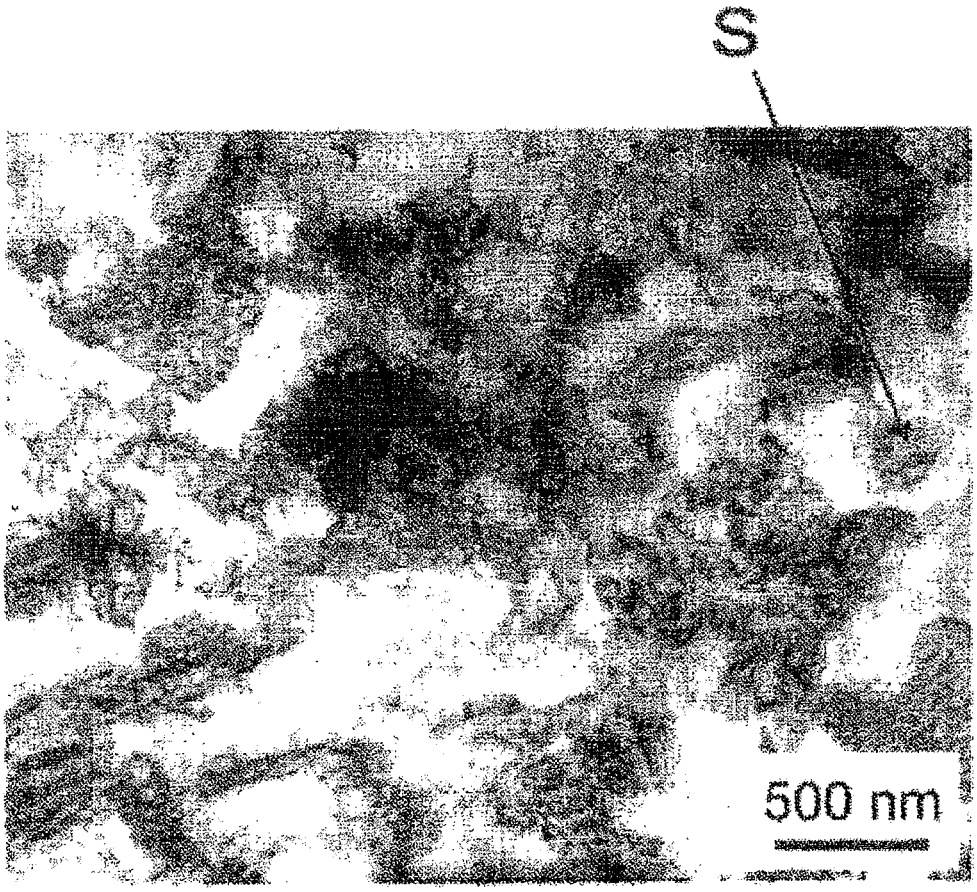
FIG. 7 is a photograph of the microstructure of the alloy of Example 6; S indicates an example of subgrain, and the region shown by the same pattern and the same contrast is subgrain; and the regions near to white and sandwiched between the subgrains are also subgrains.

G: Crystal Grain (grain boundary surrounded by high angle grain boundary (misorientation angle, at least 15°))
S: Subgrain (grain boundary having a misorientation angle of at most 5°)
RD: Direction Parallel to Grooved Rolling
TD: Direction Perpendicular to Grooved Rolling
Max: Maximum Peak Intensity of X-ray under Test Condition

The invention claimed is:

1. A magnesium alloy mainly comprising magnesium,
wherein the magnesium alloy comprises crystal grains having a crystal grain structure,
wherein repetitive shear strain is introduced into the magnesium alloy by rolling the magnesium alloy with grooved rolls consisting of an upper roll and a lower roll disposed opposite to the upper roll,
wherein the crystal grain structure has a high angle grain boundary,
wherein an inside of a crystal grain surrounded by the high angle grain boundary is composed of subgrains,
wherein grooves of the grooved rolls have a triangular or the like cross-section configuration and diamond-like holes, hexagonal holes or oval holes are formed when the upper and the lower rolls are kept in contact with each other, and
wherein tensile yield stress (A), compressive yield stress (B) and yield stress anisotropy ratio (B/A) of the magnesium alloy are at least 300 MPa, at least 220 MPa and at least 0.7, respectively.

2. The magnesium alloy as claimed in claim 1,
wherein the crystal grains have a mean grain size of at most 5 μm and the subgrains have a mean grain size of at most 1.5 μm.

3. The magnesium alloy as claimed in claim 2,
wherein the crystal grains having a mean grain size of at most 5 μm account for at least 70% of all the crystal grains.

4. The magnesium alloy as claimed in claim 1,
wherein the repetitive shear strain is introduced into the magnesium alloy by rolling with grooved rolls having a roll peripheral speed within a range from 1 to 50 m/min.

5. The magnesium alloy as claimed in claim 1,
wherein the magnesium alloy is heated to a temperature falling within a range of from 100 to 300° C. for a period of time falling within a range of from 5 to 120 minutes before rolling with the grooved rolls.

* * * * *